US005234167A

United States Patent [19]

Martin

[11] Patent Number: 5,234,167

[45] Date of Patent: Aug. 10, 1993

[54] ONE-PIECE FOAMER NOZZLE

[75] Inventor: Douglas S. Martin, Forest City, N.C.

[73] Assignee: AFA Products, Inc., Forest City, N.C.

[21] Appl. No.: 437,550

[22] Filed: Nov. 16, 1989

[51] Int. Cl.[5] ..... B05B 1/02; B05B 11/00

[52] U.S. Cl. ..... 239/343; 239/428.5; 239/432

[58] Field of Search ..... 239/428.5, 432, 343

[56] References Cited

U.S. PATENT DOCUMENTS

| | | | |
|---|---|---|---|
| D. 293,929 | 1/1988 | Verhees | D23/213 |
| 4,350,298 | 9/1982 | Tada | 239/333 |
| 4,646,973 | 3/1987 | Focaracci | 239/428.5 |
| 4,669,665 | 6/1987 | Shay | 239/428.5 |
| 4,730,775 | 3/1988 | Maas | 239/428.5 |
| 4,767,060 | 8/1988 | Shay et al. | 239/428.5 |
| 4,768,717 | 9/1988 | Shay | 239/403 |
| 4,779,803 | 10/1988 | Corsette | 239/428.5 |

FOREIGN PATENT DOCUMENTS

| | | |
|---|---|---|
| 63-51670 | 4/1988 | Japan . |
| 1-101661 | 7/1989 | Japan . |
| 1-101662 | 7/1989 | Japan . |
| 1-203065 | 8/1989 | Japan . |
| 2-83053 | 3/1990 | Japan . |

*Primary Examiner*—Andres Kashnikow
*Assistant Examiner*—Karen B. Merritt
*Attorney, Agent, or Firm*—Thomas R. Vigil

[57] ABSTRACT

The one-piece foamer nozzle comprises an inner cap portion, an outer barrel portion, and an internal wall inside the nozzle between the cap portion and the barrel portion. The internal wall has a central orifice therethrough. The cap portion has a cavity and structure in the cavity for receiving and mating with a nose bushing mounted to the front end of a trigger sprayer. The structure has passageways adapted to register with passageways on the nose bushing when the nozzle is rotated to a predetermined position on the nose bushing to direct liquid in a swirl whereby a conical spray exits the central orifice when the trigger sprayer is operated. The outer barrel portion has an inner, generally cylindrical, wall surface. The nozzle further has a short annular formation coaxial with the orifice and fixed to and extending outwardly from the internal wall around the orifice. The short annular formation has an axial extent from the internal wall sufficient to cause a generally cylindrical inner surface of the annular formation to interfere with at least a portion of the conical spray exiting from the orifice upon operation of the trigger sprayer, whereby some of the conically sprayed liquid engaging the inner surface of the short annular formation will be deflected into the path of the conical spray of liquid flowing toward the inner, generally cylindrical, wall surface of the outer barrel portion, thereby to enhance turbulence and mixing of air and liquid in the outer barrel portion to enhance the generation of foam.

9 Claims, 3 Drawing Sheets

ONE-PIECE FOAMER NOZZLE

BACKGROUND OF THE INVENTION

1. Field of the Invention

The present invention relates to a one-piece foamer nozzle which is moveable between an "OFF" position and a "FOAM" position and which is mounted on the front end of a trigger sprayer.

2. Description Of The Related Art Including Information Disclosed Under 37 CFR §§1.97-1.99

Heretofore various foam dispensing devices have been proposed which are mountable on a trigger sprayer. Such devices include nozzle assemblies which are mountable at the front end of the trigger sprayer. All these devices include a foam generating chamber, means for admitting air into the 15 chamber, and an outlet from the chamber. In some of these devices a screen is provided for assisting in the generation of foam.

A trigger operated foam dispensing device which utilizes a foam generating chamber and a perforated wall through which foam is ejected is disclosed in the Tada U.S. Pat. No. 4,350,298. In this patent, the trigger operated foam dispensing device includes a nozzle cap with an outlet wall having a plurality of arms constituting an obstacle wall against which liquid from a spray or stream outlet orifice collides, thereby to mix with air in the nozzle cap to form foam which exits the nozzle cap through three or more openings formed between the arms of the outlet wall.

A two position foam nozzle assembly for use with a trigger sprayer is disclosed in Japanese Patent Publication No. 133358/1981.

Another two-position nozzle assembly having an "OFF" position and a "FOAM" generating position established by rotation of the nozzle assembly about a nozzle bushing is disclosed in the Maas U.S. Pat. No. 4,730,775, entitled TWO-PIECE FOAMER NOZZLE ASSEMBLY. In this patent, a foam generating chamber is provided that is positioned forwardly of an orifice within the nozzle assembly and foam created in the foam generating chamber passes into a foam accumulating chamber, the two chambers being separated by three spokes or a Y formation.

Japanese Patent Publication 63-51670, published in 1988, discloses a foam nozzle assembly wherein a foam generating chamber is positioned in front of an orifice within the inside of the nozzle assembly and foam exits directly from the foam generating chamber.

In the Shay et al U.S. Pat. No. 4,767,060 there is disclosed a nozzle which is capable of selectively dispensing a liquid product as a foam or a spray. In this nozzle, an annular foamer member is moveable axially of the nozzle axis from a position adjacent an outlet orifice in the nozzle body to a position spaced forwardly of the nozzle orifice where the spray from the nozzle orifice can engage an inside surface of a sleeve of the foamer member for making foam.

In the Shay U.S. Pat. No. 4,768,717 there is disclosed a nozzle including a cylinder defining a foam generating chamber. An orifice is located in the nozzle at the entrance end of the foam generating chamber. One or more air passageways within the nozzle allow air to enter into the entrance end of the foam generating chamber. A spray of liquid from the orifice into a foam generating chamber mixes with the air entering from both axial ends of the cylindrical foam generating chamber to form foam.

The Corsette U.S. Pat. No. 4,779,803 discloses a manually actuated liquid sprayer which is adapted to generate foam when a ported movable element is moved to an axially extended position. The element has a central cylindrical port therein larger than an outlet orifice positioned behind the element. Liquid sprayed from the orifice engages the cylindrical wall of the central port to create foam when the element is extended.

A trigger sprayer nozzle having an outer shape similar to the shape of the one piece foamer nozzle of the present invention is illustrated in the Verhees U.S. Pat. No. 293,929.

As will be described in greater detail hereinafter, the one-piece foamer nozzle of the present invention differs from the previously proposed foamer nozzle assemblies and, in particular, from the one-piece foamer nozzle illustrated in U.S. Pat. No. 293,929 by providing, in addition to an outer barrel portion in the nozzle which forms a foam generating chamber, an annular formation extending a short distance forwardly from a wall within the outer barrel portion which has an orifice from which liquid is sprayed in a conical spray into and against the inner surface of the outer barrel portion forming the foam generating chamber. It has been discovered that this short annular formation increases, enhances or facilitates the generation of foam, as a result of some of the conical spray from the outlet orifice in the nozzle hitting the inner surface of the short annular formation and causing greater turbulence in the outer barrel portion. In this respect, the portion of the conical spray that impinges upon the inner surface of the short annular portion will be deflected into the rest of the conical spray that passes out of the short annular portion to impinge upon the inner surface of the outer barrel portion, thereby, increasing the cross flow and turbulence of liquid and air in the foam generating chamber to create foam.

SUMMARY OF THE INVENTION

According to the invention there is provided a one-piece foamer nozzle comprising an inner cap portion, an outer barrel portion, and an internal wall inside the nozzle between the cap portion and the barrel portion. The internal wall has a central orifice therethrough. The cap portion has a cavity and structure in the cavity for receiving and mating with a nose bushing mounted to the front end of a trigger sprayer. The structure has passageways, adapted to register with passageways on the nose bushing when the nozzle is rotated to a predetermined position on the nose bushing to direct liquid in a swirl, whereby a conical spray exits the central orifice when the trigger sprayer is operated. The outer barrel portion has an inner, generally cylindrical, wall surface. The nozzle further has a short annular formation coaxial with the orifice and fixed to and extending outwardly from the internal wall around the orifice. The short annular formation has an axial extent from the internal wall sufficient to cause a generally cylindrical inner surface of the annular formation to interfere with at least a portion of the conical spray exiting from the orifice upon operation of the trigger sprayer, whereby some of the conically sprayed liquid engaging the inner surface of the short annular formation will be deflected into the path of the conical spray of liquid flowing toward the inner, generally cylindrical, wall surface of the outer barrel portion, thereby to enhance turbulence and mixing of air and liquid in the outer barrel portion to enhance the generation of foam.

DESCRIPTION OF THE PREFERRED EMBODIMENTS

Figure 1:
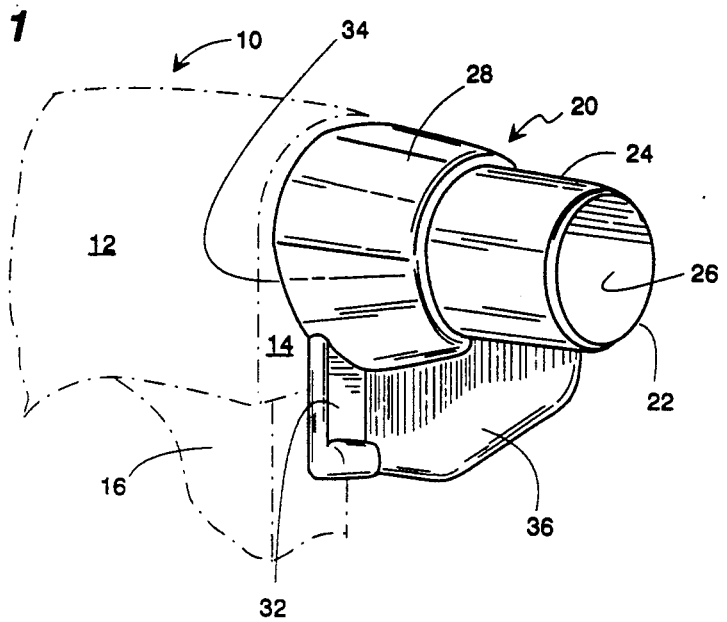
FIG. 1 is a fragmentary prospective view, in phantom, of the upper front end of a trigger sprayer and a perspective view of the one-piece foamer nozzle of the present invention.
Figure 2:
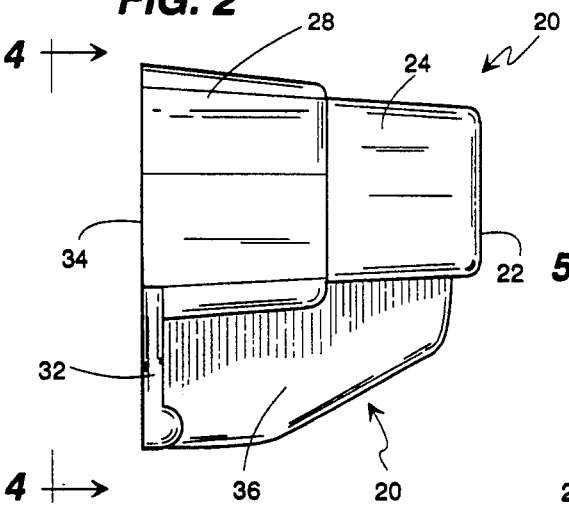
FIG. 2 is a left side elevational view of the foamer nozzle shown in FIG. 1.

Referring now to drawings in greater detail, there is illustrated, in phantom, in FIG. 1 a trigger operated liquid dispensing device or trigger sprayer 10 which has a body 12, including a front end 14 with an outer orifice not shown. The trigger sprayer 10 includes a pumping system or mechanism (not shown) mounted within the body 12. The pumping system is operated by a trigger 16 pivotally mounted to part of the body 12 (not shown).

The construction and operation of the trigger sprayer 10, briefly described above, can be of the type disclosed in the Garneau U.S. Pat. No. 4,669,664, the disclosure of which is incorporated herein by reference.

A one-piece foamer nozzle 20 constructed according to the teachings of the present invention is mounted to the nose bushing (not shown) which has been assembled into an outer opening at the front end 14 of the body 12 of the trigger sprayer 10 and is adapted to be rotated on the nose bushing from an off position (the position shown in the Figures) to a foam position (where spray indicia on the outer surface of the nozzle 20 is in an upper horizontal position) where pumping of liquid from a container (not shown) to which the sprayer 10 is attached by squeezing of the trigger 16 of the trigger sprayer 10 will result in the generation of foam in the nozzle 20 and the dispensing of foam from an outlet end 22 of an outer barrel portion 24 of the nozzle 20.

The outer barrel portion 24 has an inner, smooth, generally cylindrical wall surface 26 therein in which foam is generated.

The nozzle 20 further includes an inner cap portion 28 having a cavity 30 (FIGS. 4 and 6) in which is received the nose bushing (not shown) of the type disclosed in U.S. Pat. No. 4,730,775, for example, the disclosure of which is incorporated herein by reference, for mounting the cap portion 28 on the nose bushing.

Depending from the inner cap portion 28 is a radial flange 32 which extends from and is integral with a rear end 34 of the inner cap portion 28. A thumb or finger engageable axially extending flange 36 extends axially forwardly from the radially extending flange 32.

Figure 3:
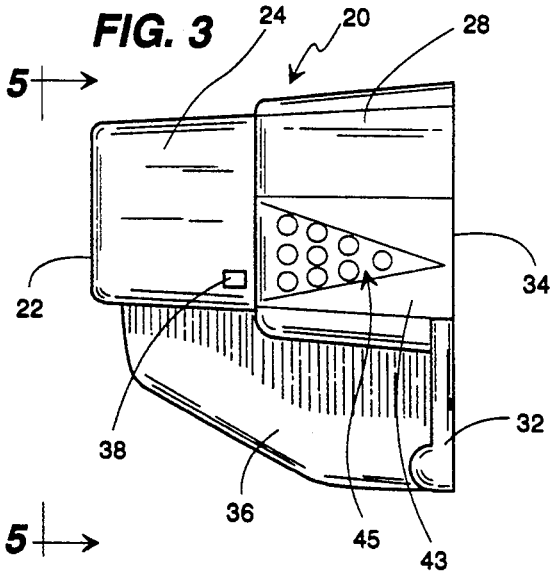
FIG. 3 is a right side elevational view of the foamer nozzle shown in FIG. 1.

As shown in FIG. 3, the outer barrel portion 24 has at least one air inlet opening 38 therein located adjacent the junction between the outer barrel portion 24 and the inner cap portion 28.

Figure 4:
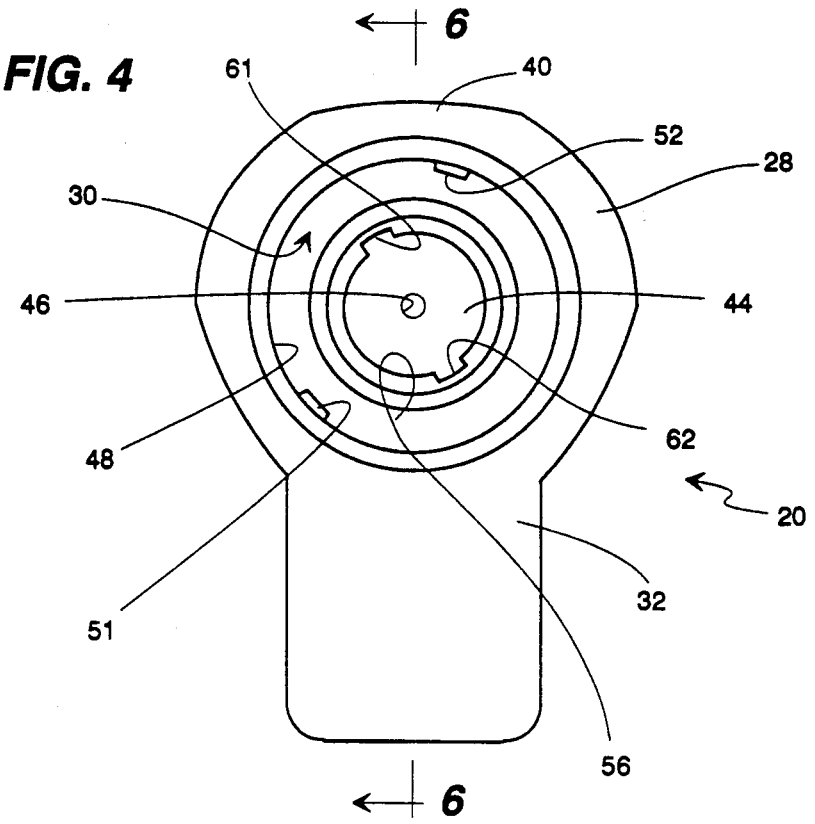
FIG. 4 is a rear elevational view of the foamer nozzle shown in FIG. 1 and is taken along line 4—4 of FIG. 2.
Figure 5:
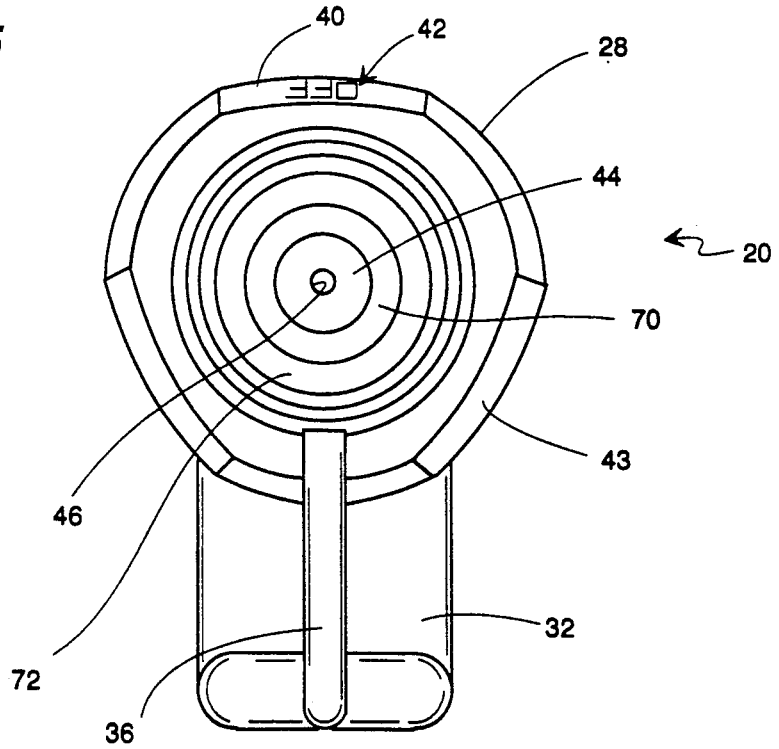
FIG. 5 is a front elevational view of the foamer nozzle shown in FIG. 1, is taken along line 5—5 of FIG. 3, and shows a short cylindrical or annular formation situated inside an outer barrel portion of the one-piece foamer nozzle.

As shown in FIGS. 4 and 5, the cap portion 28 has a rounded generally inverted triangular configuration with a generally horizontal top surface 40 which is shown in FIG. 5 and has indicia 42 thereon in the form of the word "OFF". Another surface 43 (FIG. 3) has spray indicating indicia 45 in the form of a group of small circles (representing bubbles) inside a "V" on it's side (representing a conical spray of foam).

Figure 6:
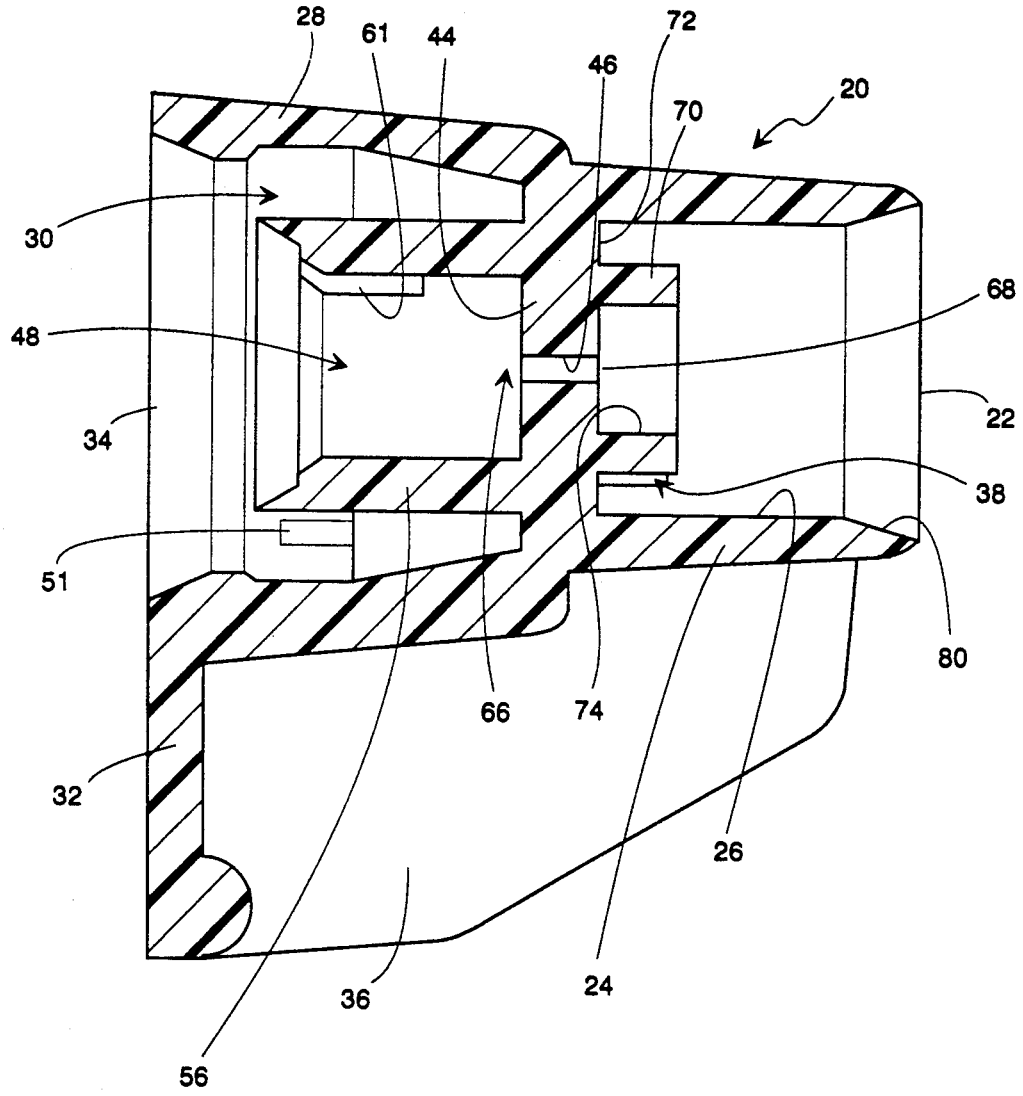
FIG. 6 is a sectional view taken along line 6—6 of FIG. 4 and shows the short annular formation extending forwardly from an interior wall within the one-piece foamer nozzle and into the outer barrel portion.

As shown in FIGS. 4, 5 and 6, inside the nozzle 20 is an internal wall 44 which separates the inner cap portion 28 from the outer barrel portion 24 and which has a central orifice 46 therethrough.

FIG. 4 is a rear elevational back or end view of the nozzle 20 and shows a generally cylindrical cavity 48 in the cap portion 28 and first and second stop members 51 and 52 which limit the rotation of the nozzle 20 on the nose bushing (not shown). In this respect, the stops 51 and 52 are positioned to engage respective stops or bosses on the nose bushing (not shown) at the two rotational positions of the nozzle 20.

As shown in FIGS. 4 and 6, the inner cap portion 28 also has an internal cylinder 56 extending rearwardly from said internal wall 44 which is adapted to mate with a cylindrical projection on the nose bushing (not shown) whereby liquid can be directed into the internal cylinder 56 through passageways 61 and 62 formed in the internal cylinder which mate or register with passageways (not shown) in the nose bushing (not shown) so that liquid is directed to a space 66 in front of the internal wall 44 and caused to flow in that space 66 in a swirl so that swirling liquid will flow through the central orifice in the internal wall 44 and be ejected from an outlet end 68 (FIG. 6) of the orifice 46 in a conical spray pattern subtending an angle between 30° and 50°.

The manner in which the passageways 61 and 62 cooperate with passageways on the nose bushing to cause liquid to flow in a swirl pattern in the space 66 in front of the internal wall 44 is disclosed in the Quinn U.S. Pat. No. 4,234,128 and the Dobbs U.S. Pat. No. 4,706,888, the disclosures of which are incorporated herein by reference.

As shown in FIGS. 1 and 6, the outer barrel portion 24 has the smooth inner cylindrical wall surface 26 against which liquid exiting the outlet end 68 of the orifice 46 in a spray pattern can impinge and be deflected to mix with air.

According to the teachings of the present invention and as best shown in FIG. 6, a short cylindrical or annular formation 70 is provided inside the outer barrel portion 24 coaxial with the central orifice 46 and extending outwardly from a front surface 72 of the internal wall 44 a short distance.

The short annular formation 70 is designed to have an axial extent sufficient so that at least some of the conical spray exiting from the outlet end 68 (FIG. 6) of the orifice 46 impinges upon an inner wall surface 74 of the short annular formation 70 so that liquid is deflected therefrom toward the inner wall surface 26 of the outer barrel portion 24 and intersecting the path of other conically sprayed liquid from the outlet end 68 (FIG. 6) of the orifice 46 or deflected from the inner wall surface 74 of the short annular formation 70, thereby to create greater mixing and turbulence in the liquid droplets and air inside the foam generating chamber (defined within the outer barrel portion 24) than would be obtained if the short annular formation 70 was not provided.

It has been observed that better foam is generated with the short annular formation 70 in the outer barrel portion 24 than without. In this respect, the foam has a thicker consistency with smaller bubbles and with less liquid dripping from the outer barrel portion 24.

Although not known with absolute certainty, it is believed that the short annular formation 70 should be only so long as to prevent some of the conical spray from impinging directly upon the inside surface of the outer barrel portion 24 and not so long as to have all the conical spray impinging upon the inner wall surface 74 with mixing taking place solely within the short annular formation 70.

Additionally, the short annular formation 70 performs two other functions, namely: (1) by standing higher than or forward of the air inlet opening 38, it forces air to circulate around the outer diameter of this annular wall formation 70 creating a more uniform mixture of air with the conical spray thereby enhancing the foam characteristics; and (2) by standing higher than or forward of the air inlet opening 38, it prevents any foreign spray direction from outlet end 68 of the orifice 46 going through the air inlet opening 38.

In one preferred embodiment, the axial extent of the internal wall 74 of the short annular formation was approximately 0.064 inches and the axial extent of the foaming chamber, inner wall surface 26, within the outer barrel portion 24 from the internal wall 44 to the outer end 22 of the outer barrel portion 24 was approximately 0.260 inches.

The diameter of the central orifice 46 was approximately 0.024 inches and the inner diameter of the short annular formation 70 was 0.103 inches. The outer diameter of the short annular formation 70 was approximately 0.167 inches and the inner diameter of the outer barrel portion 24 (inner wall surface 26) was approximately 0.234 inches. The cone of the spray exiting from the outlet end 68 of the orifice 46 subtended an angle of between approximately 30° and 50°. One air inlet opening 38 (FIG. 3) was provided having a generally square shape with a dimension of approximately 0.050 inch per side.

To facilitate the outlet flow of foam from the outer barrel portion 24, an inner forward surface 80 thereof (FIG. 6) is tapered at an angle of approximately 15° for a length of approximately 0.058 inches as shown in FIG. 6.

From the foregoing description, it will be apparent that the foamer nozzle of the present invention has a number of advantages, some of which have been described herein, for example improved foam generation, and others of which are inherent in the foamer nozzle. Also modifications can be made to the foamer nozzle described herein without departing from the spirit or scope of the invention as defined in the accompanying claims. Accordingly, the scope of the present invention is only to be limited as necessitated by the accompanying claims.

We claim:

1. A one-piece foamer nozzle comprising an inner cap portion, an outer barrel portion, and an internal wall inside the nozzle between said cap portion and said barrel portion, said internal wall having a central orifice therethrough, said cap portion having a cavity and structure in said cavity for receiving and mating with a nose bushing mounted to the front end of a trigger sprayer, said structure having passageways, adapted to register with passageways on the nose bushing when said nozzle is rotated to a predetermined position on the nose bushing, to direct liquid in a swirl, whereby a conical spray exits the central orifice when the trigger sprayer is operated, said outer barrel portion having an inner, generally cylindrical, wall surface, and a short annular formation coaxial with said orifice fixed to and extending outwardly from said internal wall around said orifice and having an outer annular surface, said short annular formation having an axial extent from the internal wall sufficient to cause a generally cylindrical inner surface of said annular formation to interfere with at least a portion of the conical spray exiting from said orifice upon operation of said trigger sprayer, and said outer barrel portion having one small air inlet opening therethrough located adjacent the junction between said outer barrel portion and said inner cap portion and opening inside said outer barrel portion adjacent said internal wall and opposite the outer annular surface of said short annular formation, whereby some of the conically sprayed liquid engaging the inner surface of said short annular formation will be deflected into the path of the conical spray of liquid flowing toward said inner, generally cylindrical, wall surface of said outer barrel portion, thereby to enhance turbulence and mixing of air and liquid in said outer barrel portion to enhance the generation of form.

2. The nozzle of claim 1 wherein the portions of said nozzle and said orifice are constructed and dimensioned so that liquid exits from said outlet orifice in a conical spray in which the cone subtends an angle of between approximately 30° and 50°.

3. The nozzle of claim 1 wherein said short annular formation has an axial extent outwardly from said internal wall is approximately 0.064 inches.

4. The nozzle of claim 1 wherein the diameter of said inner wall surface of said short annular formation is approximately 0.103 inches.

5. The nozzle of claim 1 wherein said diameter of said outlet orifice is approximately 0.024 inches.

6. The nozzle of claim 1 wherein the diameter of said inner wall surface of said outer barrel portion is approximately 0.234 inches.

7. The nozzle of claim 1 wherein the length of said outer barrel portion from said internal wall is approximately 0.260 inches.

8. The nozzle of claim 1 wherein said air inlet opening has a generally small square shape.

9. The nozzle of claim 8 wherein said inlet opening has side dimensions of approximately 0.050 inch and the axial extent of said short annular formation is approximately 0.064 inch.

* * * * *